US009211025B1

(12) United States Patent
Elhawwashy

(10) Patent No.: US 9,211,025 B1
(45) Date of Patent: Dec. 15, 2015

(54) POSTAL CUBE

(71) Applicant: Walid Elhawwashy, Chevy Chase, MD (US)

(72) Inventor: Walid Elhawwashy, Chevy Chase, MD (US)

( * ) Notice: Subject to any disclaimer, the term of this patent is extended or adjusted under 35 U.S.C. 154(b) by 0 days.

(21) Appl. No.: 14/511,230

(22) Filed: Oct. 10, 2014

(51) Int. Cl.
*A47G 29/122* (2006.01)
*A47G 29/126* (2006.01)

(52) U.S. Cl.
CPC ..... *A47G 29/1225* (2013.01); *A47G 29/126* (2013.01); *A47G 2029/1226* (2013.01); *A47G 2200/143* (2013.01); *A47G 2200/146* (2013.01); *A47G 2200/223* (2013.01)

(58) Field of Classification Search
CPC ..... A47G 29/1212; A47G 29/1214; A47G 29/1225; A47G 29/1226; A47G 29/1228; A47G 29/124; A47G 29/126; A47G 29/141; A47G 2029/146; A47G 2029/148; A47G 2029/149; A47G 29/16; A47G 29/20; A47G 29/30; A47G 2200/223; A47G 2200/143; A47G 2200/146; A47G 2029/1226; G07C 9/00896; G07C 9/00571; G07C 9/00912
USPC ..... 232/17, 19, 34–37, 45; 340/568.1, 569, 340/5.73; 70/63, 158; 200/61.63
See application file for complete search history.

(56) References Cited

U.S. PATENT DOCUMENTS 4,836,352 A * 6/1989 Tateno et al. ..... 194/215
5,774,053 A * 6/1998 Porter ..... 340/568.1
5,979,750 A * 11/1999 Kindell ..... 232/19
6,028,517 A * 2/2000 Sansone et al. ..... 340/569
6,483,433 B2 * 11/2002 Moskowitz et al. ..... 340/568.1
6,533,167 B2 * 3/2003 Hassan ..... A47G 29/1216 232/17
6,715,669 B2 * 4/2004 Hara ..... G07C 9/00103 232/19
6,840,438 B2 * 1/2005 Hassan ..... A47G 29/1216 232/39
7,175,071 B1 * 2/2007 Slagle ..... A47G 29/16 220/833
7,182,246 B1 * 2/2007 Sievel ..... A47G 29/22 232/45
7,256,691 B2 * 8/2007 Awobue ..... A47G 29/1214 232/17
2001/0045449 A1 * 11/2001 Shannon ..... 232/19
2003/0226883 A1 * 12/2003 Liphard ..... 232/1 R
2004/0074957 A1 * 4/2004 Devar ..... 232/17
2004/0133304 A1 * 7/2004 Fobbe et al. ..... 700/214
2007/0181662 A1 * 8/2007 Satherblom et al. ..... 232/45
2008/0067227 A1 * 3/2008 Poss et al. ..... 232/17

* cited by examiner

*Primary Examiner* — William Miller

(74) *Attorney, Agent, or Firm* — Michael L. Greenberg, Esq.; Greenberg & Lieberman, LLC

(57) ABSTRACT

A device configured to securely and automatically receive parcel is described. The device is equipped with a front door and an automatic top rolling door in order to accommodate parcel delivery via conventional parcel delivery personnel, or delivery via airlift from an unmanned aerial vehicle (UAV). The device is also equipped with a secure internet connection which facilitates communication between recipient and delivery personnel, as well as expedites the delivery confirmation process upon parcel delivery. Audio and video capture and transmission equipment on-board the device permit the recipient to remotely provide access to the device upon authentication of identity and/or credentials.

4 Claims, 4 Drawing Sheets

POSTAL CUBE

FIELD OF THE PRESENT INVENTION

The present invention relates generally to package delivery receptacles, and more specifically, to the package delivery systems by which recipients and delivery personnel interact with a delivered parcel or package.

BACKGROUND OF THE PRESENT INVENTION

While the parcel delivery system of the world continues to expand its reach and expedite its delivery processes, little has changed in nearly a century when it comes to the final resting place of a package or envelope at a delivery destination. The conventional 'mailbox' or 'post box' have been employed for decades as a convenient and effective location to store packages that have been delivered, or that have yet to be picked up by delivery personnel.

Unfortunately, the mailbox system in use today employs minimal security, both from unwanted thieves or trespassers, but from the elements as well. With the advent of more network-connected package delivery systems employed by such companies including UPS, FedEx, USPS, and DHL, which employ advanced package tracking equipment and data, there is no reason why package recipients should not also benefit from a more secure package delivery receptacle.

Thus, there is a need for a more advanced, 'smart' parcel receptacle, capable of interacting with delivery personnel, securing parcel according to access permissions, alerting both the delivery company and the recipient when parcel is delivered or picked up from the parcel receptacle, and providing a secure vessel for package delivery via an unmanned aerial vehicle (UAV).

SUMMARY OF THE PRESENT INVENTION

The present invention is a smart delivery receptacle envisioned to augment, or even replace an individual's package delivery box, post box, or mailbox. The present invention is preferably in constant communication with a WiFi router connected to the internet within the household. Via this connection, the present invention is equipped to track mail and packages in real time by employing tracking numbers present on each package, or with the delivery individual. The preferred embodiment of the present invention is equipped with a front door which provides easy access to a package compartment for the package recipient and for a delivery individual with clearance. The package compartment is equipped to handle packages that vary in size.

Additionally, the present invention is preferably equipped with a top automatic rolling door in order to provide an easy drop off location for package delivery via UAV from above, such as via a delivery drone. Both the front door and the top automatic rolling door are preferably locked via a conventional electromagnetic lock. A front slot, which preferably closes, provides a location for safe envelope and other paper-based delivery. The present invention is also equipped with a variety of sensors to provide a means for the present invention to interact with the recipient, the packages, and the delivery individual. These sensors include, but are not limited to barcode scanners, scale sensors, temperature sensors, and proximity sensors. The barcode scanners are configured to scan the barcode on the package, regardless of the orientation of the barcode on the package, and to also read confirmation barcodes or other critical barcodes containing information pertaining to package delivery with which the delivery individual employs for package reference, identification, and location data.

It is envisioned that the present invention provides a delivery confirmation to both the delivery company, as well as the recipient upon delivery of the package within the package receptacle. The present invention preferably employs the barcode scanners and scale sensors to confirm and verify that the correct package has been delivered, and that the weight of the package is proximal to the expected or documented weight of the package, as provided via the information commonly found within the barcode of the package.

The weight of the package is assessed via the scale incorporated into the flooring of the package receptacle. The scale is configured to detect the presence of a piece of parcel and weigh it. An onboard computer, such as a micro-controlled Raspberry Pi TM, is preferably used to communicate parcel related data to both delivery personnel and to the recipient via an on-board WiFi radio connected to the internet supplied by the Internet Service Provider to the household via the WiFi router of the household.

The present invention is also preferably equipped with a variety of interactive elements, such as a digital display, which are elaborated upon in the Detailed Description of the Present Invention portion of this application.

DETAILED DESCRIPTION OF THE PREFERRED EMBODIMENT

Figure 1:
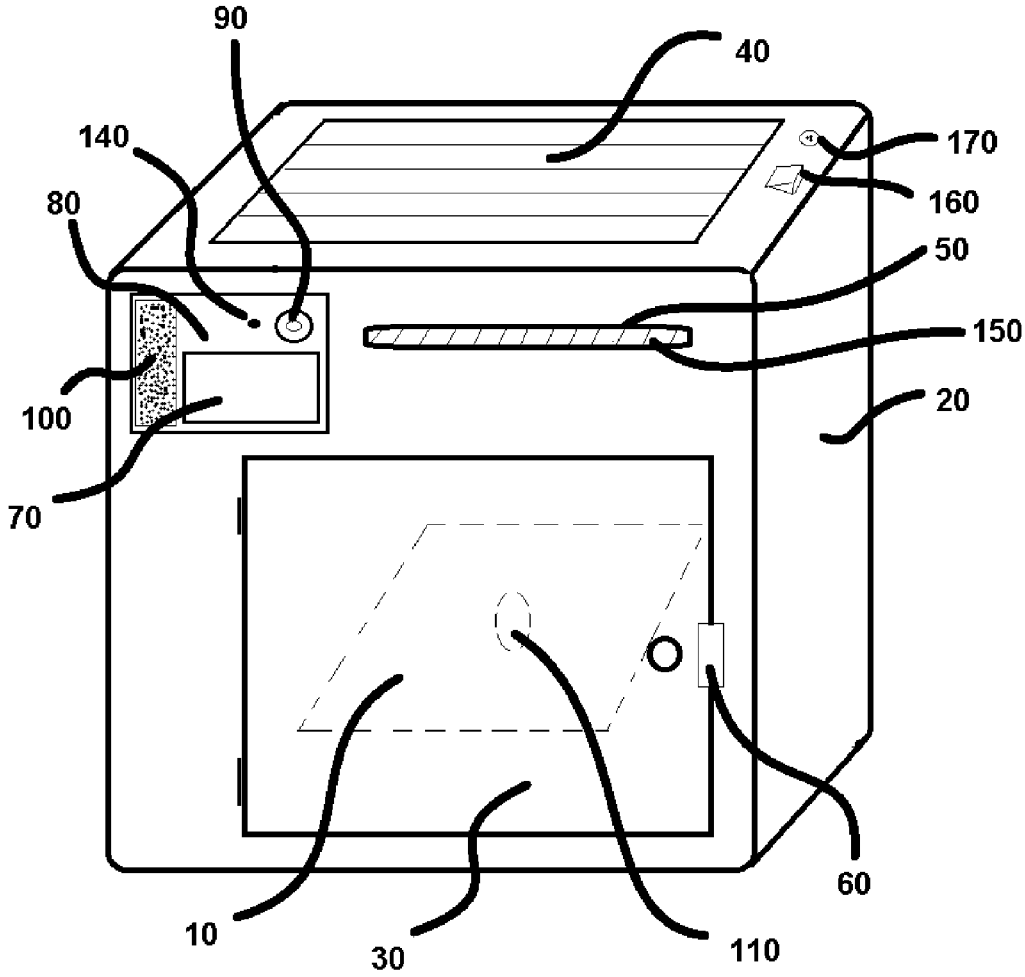
FIG. 1 shows the preferred embodiment of the present invention as seen from the front.
Figure 2:
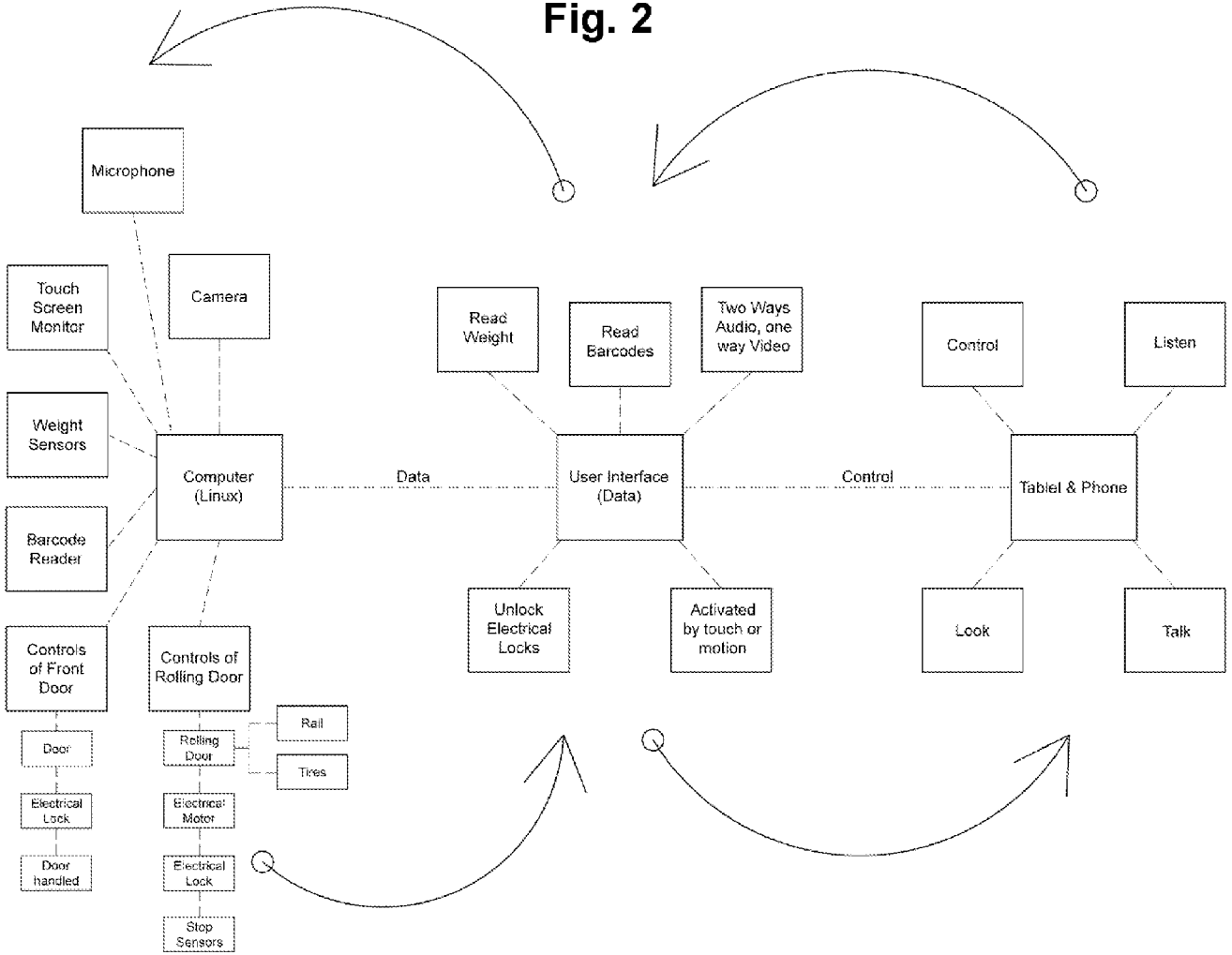
FIG. 2 exhibits a flow chart detailing the inter-related elements of the present invention.
Figure 3:
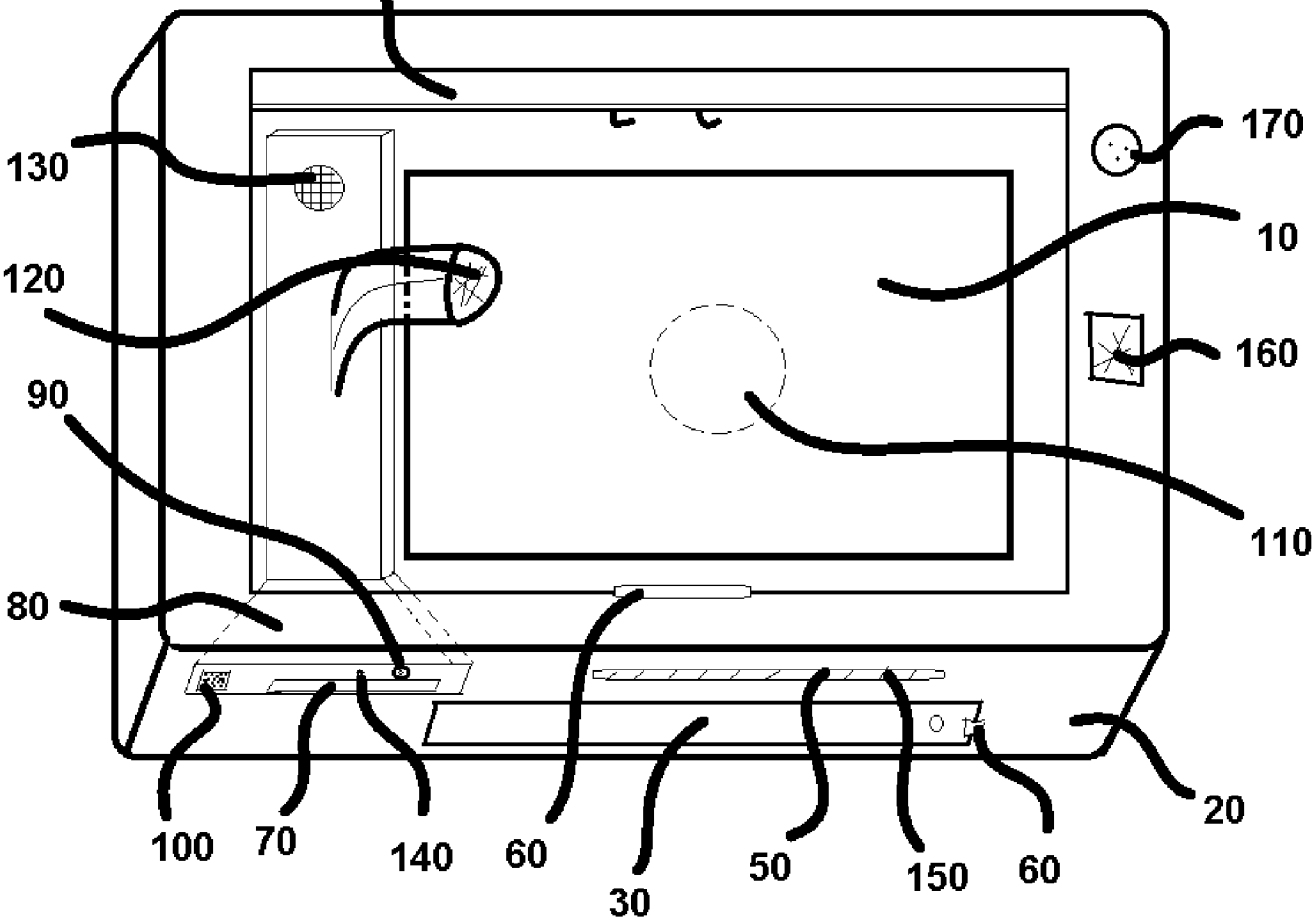
FIG. 3 displays a cut-away view of the present invention, displaying the inside of the package receptacle of the present invention, as though the top automatic door was open, as seen from an above angle.
Figure 4:
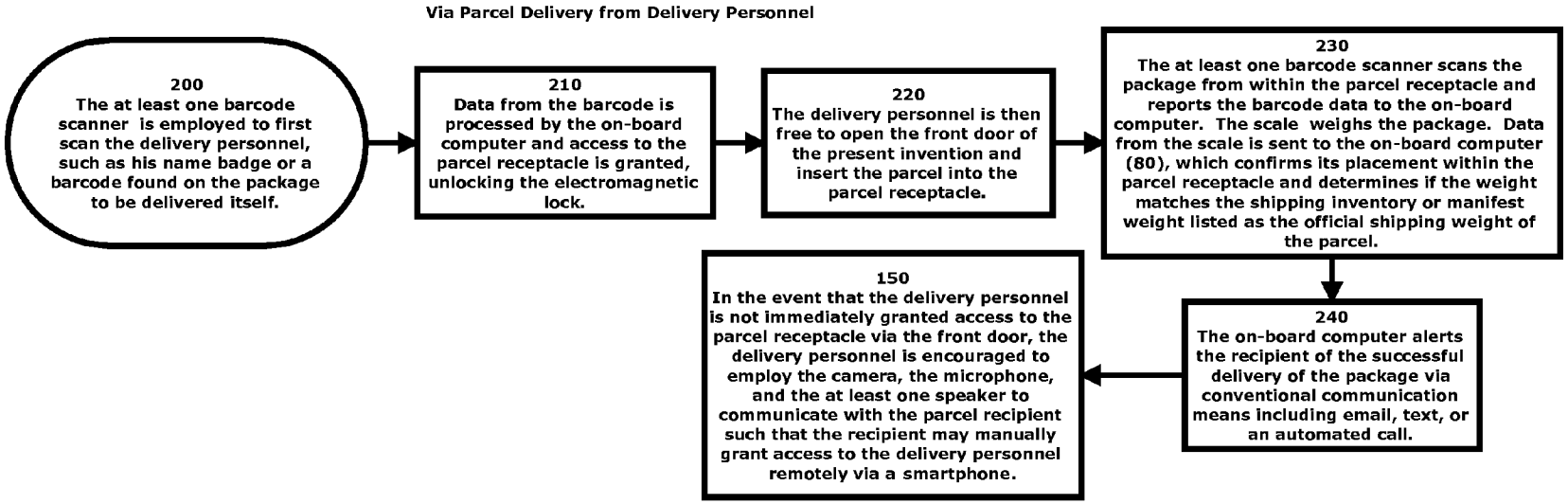
FIG. 4 details a flow chart explaining the process of use of the present invention within a conventional delivery system.

The present invention is a self-contained, interactive, smart parcel delivery receptacle device. The present invention is preferably equipped with a parcel receptacle (10), an outer casing (20), a front door (30), a top door (40), an envelope slot (50), and an on-board computer (80) connected to the internet. The front door (30), the top door (40), and the envelope slot (50) are preferably kept closed unless a package is entering or leaving the parcel receptacle (10), and are securely locked via an electromagnetic lock (60) when sealed. As such, the envelope slot (50) is also preferably equipped with an envelope slot door (150) just within the envelope slot (40), which is configured to be unlocked and opened according to instructions posited by the owner or the mail carrier. The top door (40) is preferably equipped with an automatic rolling or sliding door, similar to a conventional garage door. The top door (40) is configured to receive parcel that is airlifted to its destination, such as by a UAV or drone. Adjacent to the top door (40), the top of the present invention is equipped with a conventional motion detection sensor, oriented upward. Additionally atop the present invention, adjacent to the top door (40), an external barcode scanner (160) is disposed. The motion detection sensor is configured to activate the external barcode scanner (160) in preparation to scan a package delivered via UAV or the UAV itself.

The preferred embodiment of the present invention is also equipped with a digital display (70) in communication with the on-board computer (80). The digital display (70) is preferably a touch screen, which provides an avenue for the delivery individual and the recipient to interact with the present invention. A camera (90), microphone (140) and at least one speaker (100) are present on the front of the present invention, as seen in FIG. 1, and are configured to interface with the on-board computer (80) as well. The digital display (70) employed in the preferred embodiment of the present invention is preferably a 2.5 inch color touchscreen display. The camera (90), microphone (140), and digital display (70), as interfaced with the on-board computer (80) facilitates audio and video communication via the WiFi connection of the network. The on-board computer (80) of the present invention is preferably equipped with a unique IP and MAC address.

Additionally, the present invention is equipped with a variety of sensors configured to provide the on-board computer (80) with data pertaining to the parcel delivered to (or removed from) the parcel receptacle (10) of the present invention. These sensors include, but are not limited to a scale (110), configured to detect the presence of a parcel as well as to weigh the parcel, at least one barcode scanner (120), configured to confirm the parcel identification code and securely confirm receipt or withdrawal of the parcel from the parcel receptacle (10) of the present invention, and temperature scanner (130) configured to detect and monitor the ambient temperature within the parcel receptacle (10). The at least one barcode scanner (120) is configured to read the barcodes conventionally found on parcel and reference them against expected package's identification number, potentially as well as the delivery client's own package database to confirm delivery and delivery time of the delivered parcel. This information obtained via the at least one barcode scanner (120) is relayed to the owner of the device of the present invention via email or text. It is envisioned that at least one barcode scanner (120) may be present both on the front of the outer casing (20) of the present invention, as well as within the parcel receptacle (10).

Additionally, the present invention may be equipped with a variety of other sensors (i.e. infrared receiver, RF radio, Bluetooth radio, etc.) configured to facilitate communication with a variety of UAV's originating from a variety of manufacturers. For example, a UAV may employ an RF transmission or blast to alert the present invention of its presence for a delivery, indicating a secure signal to open the top door (40) so that the parcel may be airlifted into the parcel receptacle (10). The parcel receptacle (10) may be equipped with a parcel platform, essentially a flat surface on which to rest parcel after delivery within the parcel receptacle (10). This floor of the parcel receptacle, or the parcel platform, may be equipped with a non-slip, anti-bacterial surface.

The front door (30) is configured to receive parcel conventionally, via manual drop-off or pick-up. The at least one barcode scanner (120) is configured to scan the barcode on the package from both outside of the outer casing (20) and process the information through the on-board computer (80) to know if an expected item is arriving, and to open the rolling door for delivery. That scanner will help to recognize packages delivered with drones plus what has already been mentioned as a radio or infrared signals. Also the scanner will be used in the case of hand delivery by scanning the package and processing the information before opening the front door. Once processed, and the package is recognized, the front door (30) is automatically unlocked for the carrier to place the package inside the outer casing (20) of the present invention.

The preferred process of use of the present invention is as follows:

Via Parcel Delivery from Delivery Personnel manually:

Upon approach to the device of the present invention, the at least one barcode scanner (120) is employed to first scan the delivery personnel, such as his name badge or a barcode found on the package to be delivered itself. (200) Data from the barcode is processed by the on-board computer (80) and access to the parcel receptacle (10) is granted, unlocking the electromagnetic lock (60). (210) The delivery personnel is then free to open the front door (30) of the present invention and insert the parcel into the parcel receptacle (10). (220) The at least one barcode scanner (120) scans the package from within the parcel receptacle (10) and reports the barcode data to the on-board computer (80). The scale (110) weighs the package. Data from the scale is sent to the on-board computer (80), which confirms its placement within the parcel receptacle (10) and determines if the weight matches the shipping inventory or manifest weight listed as the official shipping weight of the parcel. (230) The on-board computer alerts the recipient of the successful delivery of the package via conventional communication means including email, text, or an automated call. (240). In the event that the delivery personnel is not immediately granted access to the parcel receptacle (10) via the front door (30), the delivery personnel is encouraged to employ the camera (90), the microphone (140), and the at least one speaker (100) to communicate with the parcel recipient such that the recipient may manually grant access to the delivery personnel remotely via a smartphone. (250).

Via Delivery by UAV:

Delivery via UAV is configured to be an expedient and streamlined process that employs the top door (40), equipped with a automatic sliding door, to permit parcel to enter the parcel receptacle (10) of the present invention. Upon approach by the UAV to the device of the present invention, the UAV will preferably signal or alert the on-board computer (80) of the present invention of its presence via a conventional means of wireless communication. (260) This may vary in time, as well as with each UAV manufacturer. Once the on-board computer (80) receives and processes this signal, the top door (40) automatically opens, allowing for the UAV to position itself above the present invention, and lower or drop the parcel into the parcel receptacle (10). (270) Upon receipt of the parcel, the top door (40) automatically closes. (280) The at least one barcode scanner (120) is activated by the on-board computer (80) once the scale (110) weighs the package and conveys to the on-board computer (80) the presence of the package. (290) After confirmation of package delivery and package identification, the recipient of the package or parcel is notified electronically and automatically via the on-board computer (80). (300)

The device of the present invention is envisioned to be paired with a software application which is preferably executed and ran on a mobile device such as a smartphone, tablet, iPad, or other digital internet-connected device. Via the software application, recipients or owners of the device of the present invention are able to open and close the front door (30) and top door (40), activate the camera (90) to attain a direct visual of the delivery personnel, communicate via the mobile device to the delivery personnel via the microphone (140) and at least one speaker (100), and listen to the proximal surroundings of the device of the present invention by activating the microphone (140) on the device of the present invention. It is the intent of the software application portion of the present invention to pair with the on-board computer (80) in order to facilitate control of the device of the present invention, and to provide direct contact with the delivery personnel in order to ensure the security of home delivery.

It should be understood that the present invention is envisioned to be manufactured in a variety of sizes in order to accommodate the customer's needs. Basic sizes include small, medium, large, and extra large style devices. Similarly, it is envisioned that the device of the present invention will likely be placed at or near the conventional mailbox of the residence or business address; however it could be arranged such that the present invention is built-in at the front of a house. For cases of customization, it is envisioned that customers may opt to employ a customized version of the device of the present invention in order to match the look and style of the home. Similarly, the material the present invention is composed of may vary as well. Initial options for construction material of the present invention include steel, plastic, alloy, and steel and plastic combined together.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A parcel holding and delivery apparatus comprising:

an outer casing;

a parcel receptacle, said parcel receptacle housed within said outer casing;

a front door, said front door in communication with said outer casing;

a top door, said top door in communication with said outer casing;

an envelope slot, said envelope slot disposed on a front of said outer casing;

an on-board computer, said on-board computer housed within said outer casing;

an electromagnetic lock, said electromagnetic lock configured to lock said top door and said front door via said on-board computer;

wherein said on-board computer is in communication with the internet via a Wifi radio;

at least one barcode scanner, said at least one barcode scanner disposed within said outer casing;

a parcel platform, said parcel platform disposed on an interior bottom of said outer casing;

a digital display, said digital display disposed on said front of said outer casing, proximal to said envelope slot;

a scale, said scale disposed under said parcel platform;

at least one camera, said camera disposed on the front of said outer casing;

a microphone, said microphone disposed on the front of said outer casing;

a speaker, wherein said speaker is waterproof;

wherein said speaker is disposed on said front of said outer casing;

wherein said speaker is in communication with said on-board computer;

wherein said microphone is in communication with said on-board computer;

wherein said on-board computer is configured to permit audio-visual communication between package deliverer and package receiver via said digital display, said microphone, said camera, and said speaker;

wherein said scale is configured to weigh parcel placed on said parcel platform and relay the weight to the on-board computer; and wherein said on-board computer uses said camera, said microphone, and said speaker in operative cooperation to only permit access to said parcel receptacle to specific individuals.

2. The parcel holding and delivery apparatus of claim 1, wherein said outer casing is waterproof; and wherein said on-board computer is configured to send a delivery confirmation transmission to the parcel recipient via said Wifi radio when triggered by parcel delivery within said parcel receptacle.

3. The parcel holding and delivery apparatus of claim 2, wherein said top door is an automatic rolling retractable door; and wherein said top door is configured to receive parcel delivery via an Unmanned Aerial Vehicle.

4. The parcel holding and delivery apparatus of claim 1, wherein said top door is an automatic rolling retractable door; and wherein said top door is configured to receive parcel delivery via an Unmanned Aerial Vehicle.

* * * * *